US007870955B2

(12) United States Patent
Schmitt et al.

(10) Patent No.: US 7,870,955 B2
(45) Date of Patent: Jan. 18, 2011

(54) HORIZONTAL TROUGH FOR USE WITH CONCRETE BROOMS

(76) Inventors: Alton Edward Schmitt, 4360 Driftwood Dr., Paducah, KY (US) 42001; Eric Edward Schmitt, 4360 Driftwood, Paducah, KY (US) 42003

( * ) Notice: Subject to any disclaimer, the term of this patent is extended or adjusted under 35 U.S.C. 154(b) by 394 days.

(21) Appl. No.: 11/985,190

(22) Filed: Nov. 14, 2007

(65) Prior Publication Data

US 2008/0141934 A1 Jun. 19, 2008

Related U.S. Application Data

(60) Provisional application No. 60/874,816, filed on Dec. 14, 2006.

(51) Int. Cl.
*B65D 85/00* (2006.01)
*A47L 13/50* (2006.01)

(52) U.S. Cl. ..... 206/361; 206/362.2; 206/362.3; 206/527; 15/257.05; 404/109

(58) Field of Classification Search ..... 206/349, 206/557, 361, 362.2, 362.3, 527; 220/570, 220/563, 676, 731; 229/93; 404/109, 110; 15/257.05, 257.06
See application file for complete search history.

(56) References Cited

U.S. PATENT DOCUMENTS

| | | | | | |
|---|---|---|---|---|---|
| 3,409,931 | A | * | 11/1968 | Graf | 15/257.06 |
| 3,752,494 | A | * | 8/1973 | Dunn | 15/257.06 |
| 3,756,451 | A | * | 9/1973 | Popeil | 220/736 |
| 4,940,139 | A | * | 7/1990 | Sandt | 206/362.2 |
| 5,437,369 | A | * | 8/1995 | Spitere | 206/373 |
| 5,713,583 | A | * | 2/1998 | Hansen | 280/47.19 |
| 6,032,824 | A | * | 3/2000 | Barrow | 220/621 |

* cited by examiner

*Primary Examiner*—J. Gregory Pickett
(74) *Attorney, Agent, or Firm*—Chris Tanner

(57) ABSTRACT

A horizontal trough for use with a concrete broom is disclosed. The trough can be customized to fit various shapes and widths of concrete brooms.

8 Claims, 10 Drawing Sheets

HORIZONTAL TROUGH FOR USE WITH CONCRETE BROOMS

PRIORITY CLAIM

This application claims priority to U.S. Provisional Application No. 60/874,816, which was filed on Dec. 14, 2006.

FIELD OF THE INVENTION

This invention relates generally to a water trough, and more specifically to a horizontal trough which is useful for providing water to a broom during a concrete finishing process.

BACKGROUND OF THE INVENTION

It is important that water be continually applied to the surface of a broom being used for finishing concrete, prior to hardening. Consequently an improved means for providing water to the broom is desired.

SUMMARY OF THE INVENTION

It is an object of the present invention to provide a trough for providing water to a broom that is being used to finish concrete. It is an additional object of the present invention to make that trough customizable to many sizes of brooms, and to be portable and accessible in a construction environment. These and other objects and advantages of the invention will become readily apparent as the following description is read in conjunction with the accompanying drawings.

DETAILED DESCRIPTION OF THE PREFERRED EMBODIMENTS

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

The process of completing a concrete project has several steps. These steps include first pouring the concrete, then placing it, then leveling it, and then finishing it. The finishing step occurs when the concrete is ~90-95% solidified or hardened, and ensures that the concrete has a surface that is satisfactory for its intended purpose. The present invention is directed toward improving various factors that occur during the finishing step.

Figure 1:
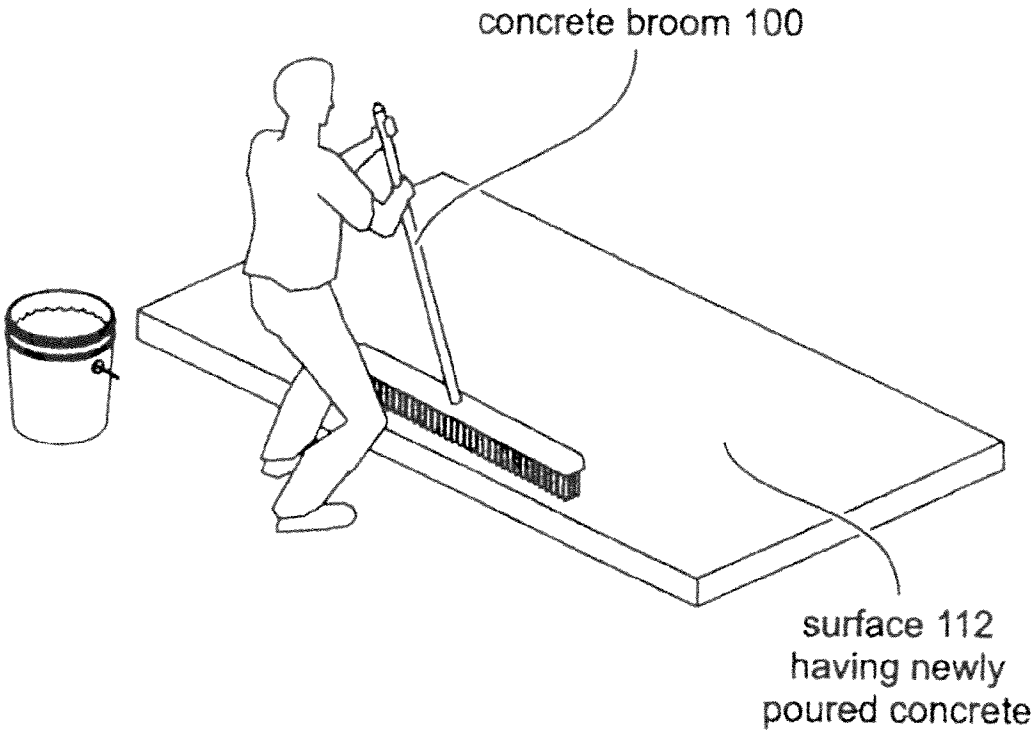
FIG. 1 PRIOR ART
FIG. 1 shows a concrete broom being used in an environment with recently poured concrete.

FIG. 1 shows a concrete broom 100 being used on a section 112 of concrete that is ~90-95% solidified or hardened and is thus ready for the finishing step. The broom 100 is used to finish the concrete, thereby providing it with a suitable surface, as stated. Although a trowel is sometimes used for finishing concrete, there are circumstances in which it is desired to use a broom 100 rather than a trowel or other device for the finishing step.

During the finishing step, it is important that water be continually applied to the broom 100 for two reasons, first that the various chunks and segments of wet concrete clinging to the broom 100 might "set" (harden, not remain liquid) thereupon. When this occurs, it is difficult to break the concrete segments away from the bristles 104 of the broom 100. Also, the stress of setting and then cracking loose the concrete chunks causes the bristles 104 to wear out more quickly, and can even ruin the broom 100 entirely. Secondly, it is necessary to have water on the broom 100 to achieve a consistent finish on the concrete surface 112.

Figure 2A:
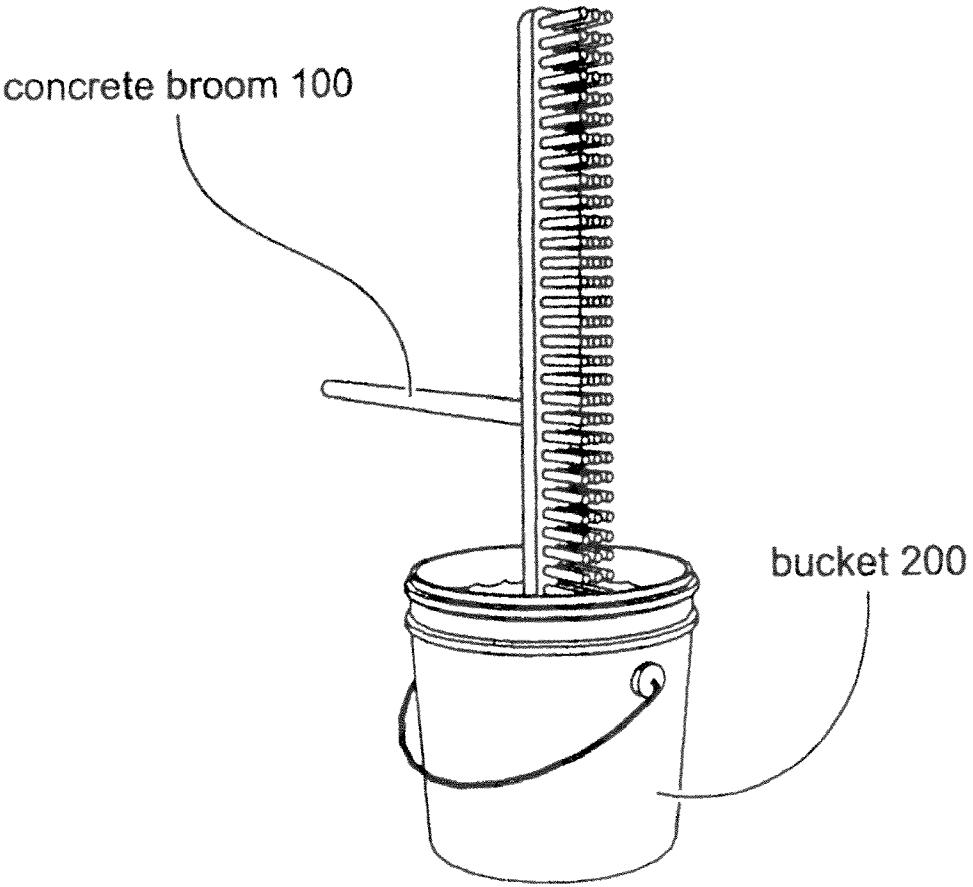
FIG. 2A PRIOR ART
FIGS. 2A-2B show a typical method of wetting the broom of FIG. 1.

To address this, FIG. 2A shows a typical method of wetting the broom of FIG. 1, which involves a five-gallon bucket 200. Five gallon buckets have the advantage that they are commonly found at construction sites, and can hold enough water to provide a reasonable amount of broom-wetting for most jobs.

Figure 2B:
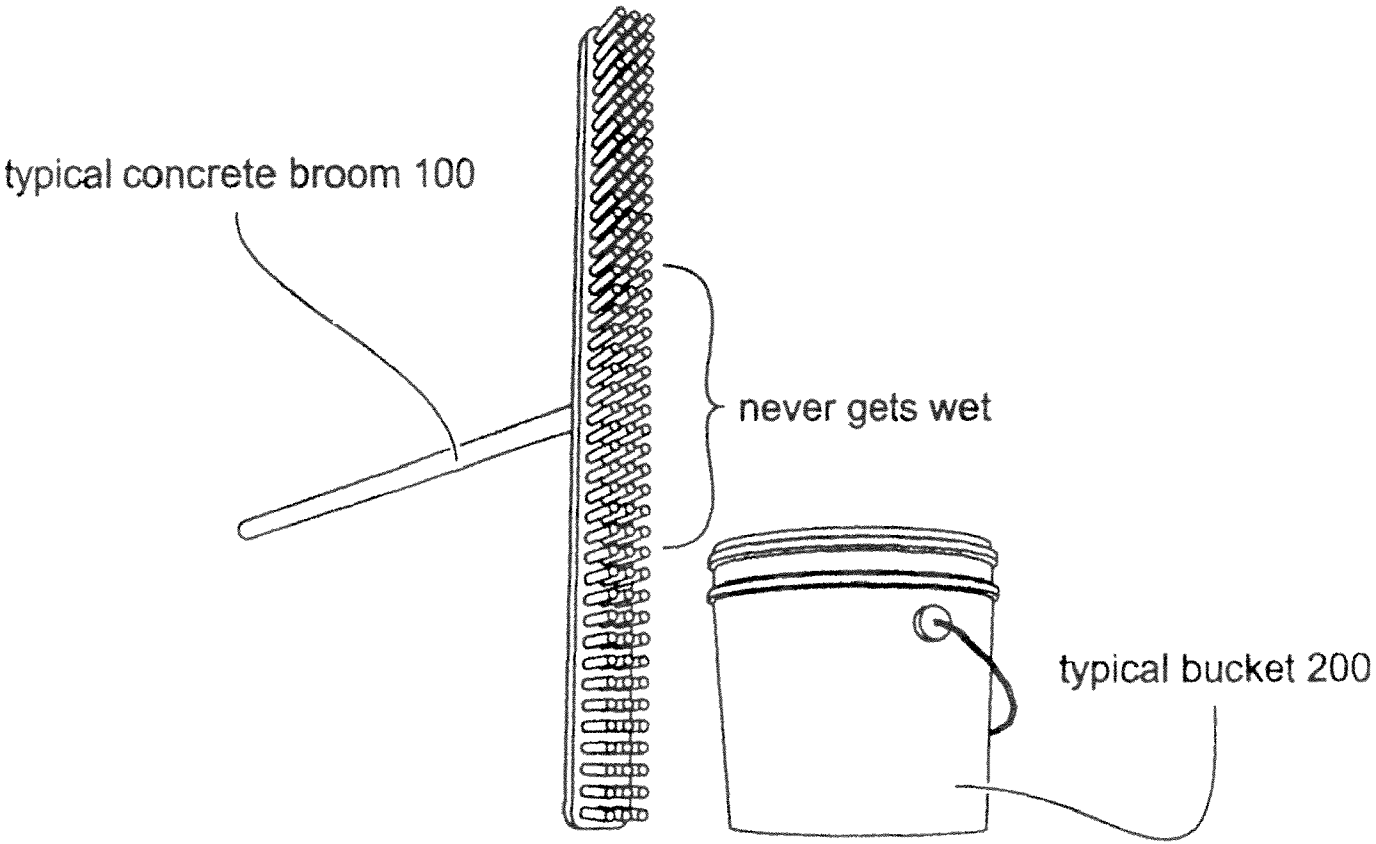
FIG. 2B PRIOR ART

The problem with using five-gallon or other buckets to wet the brooms 100 is shown in FIG. 2B. From FIG. 2B it is apparent that the broom 100 does not even half-fit within the bucket 200, so that it is necessary to turn the broom 100 over to wet it consistently. However, that will still leave a space in the middle of the broom 104 where water does not make contact.

There is also the problem of spillage of water. A user might apply some water to this middle area, but such application is unsatisfactory. Turning over the broom 100 also causes water to be shed from the bristles 104, and also splashes and spills out of the bucket 200. This in turn causes an even larger space in the middle of the broom 100 that goes without water.

Figure 3:
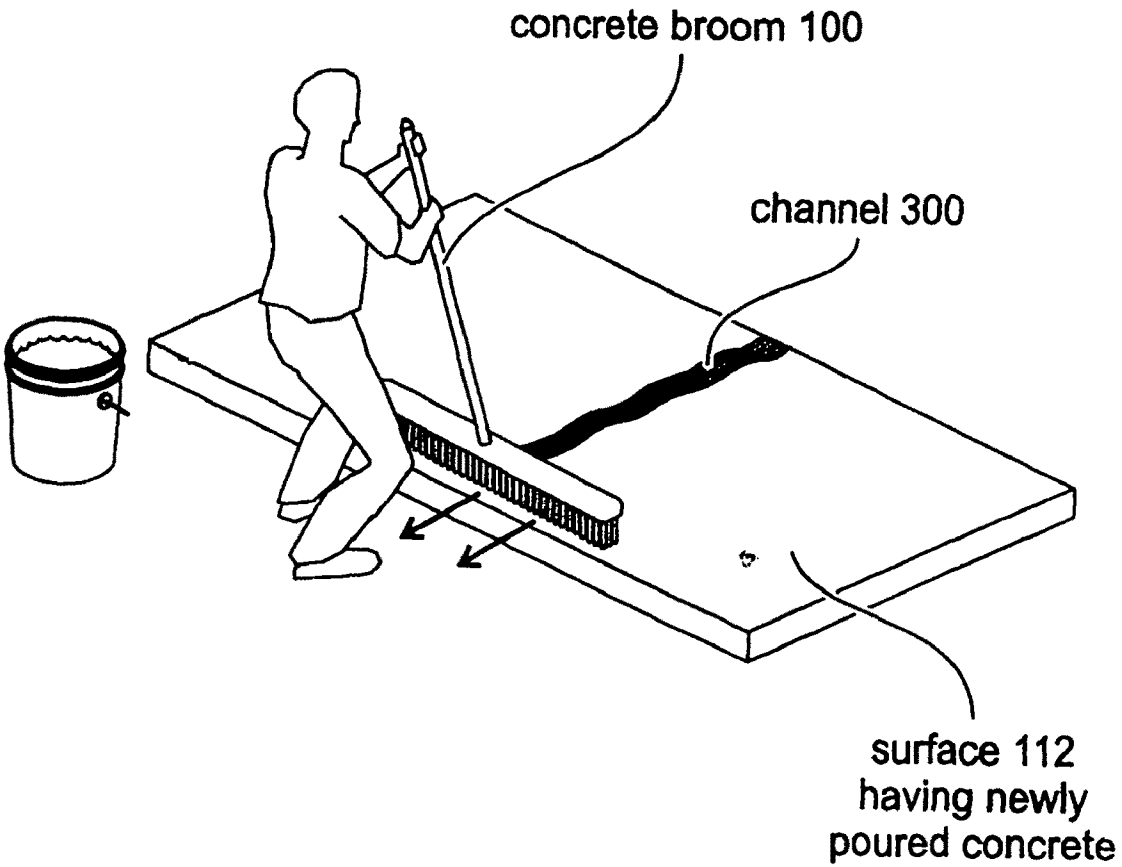
FIG. 3 PRIOR ART
FIG. 3 shows a broom that has been improperly wetted.

FIG. 3 shows what happens when one uses a broom 100 that has been improperly wetted. A scratch or irregular channel 300 can appear in the concrete, which is caused by the middle of the broom 100 having unwanted chunks attached, thereby obfuscating smoothness and consistency on the surface of the section 112 of fresh concrete. It is then necessary for the user to re-smooth the channel 300, perhaps by tilting the broom 100 to have the best wetted surface applied thereto. Such tilting is disadvantageous for several reasons.

Figure 4A:
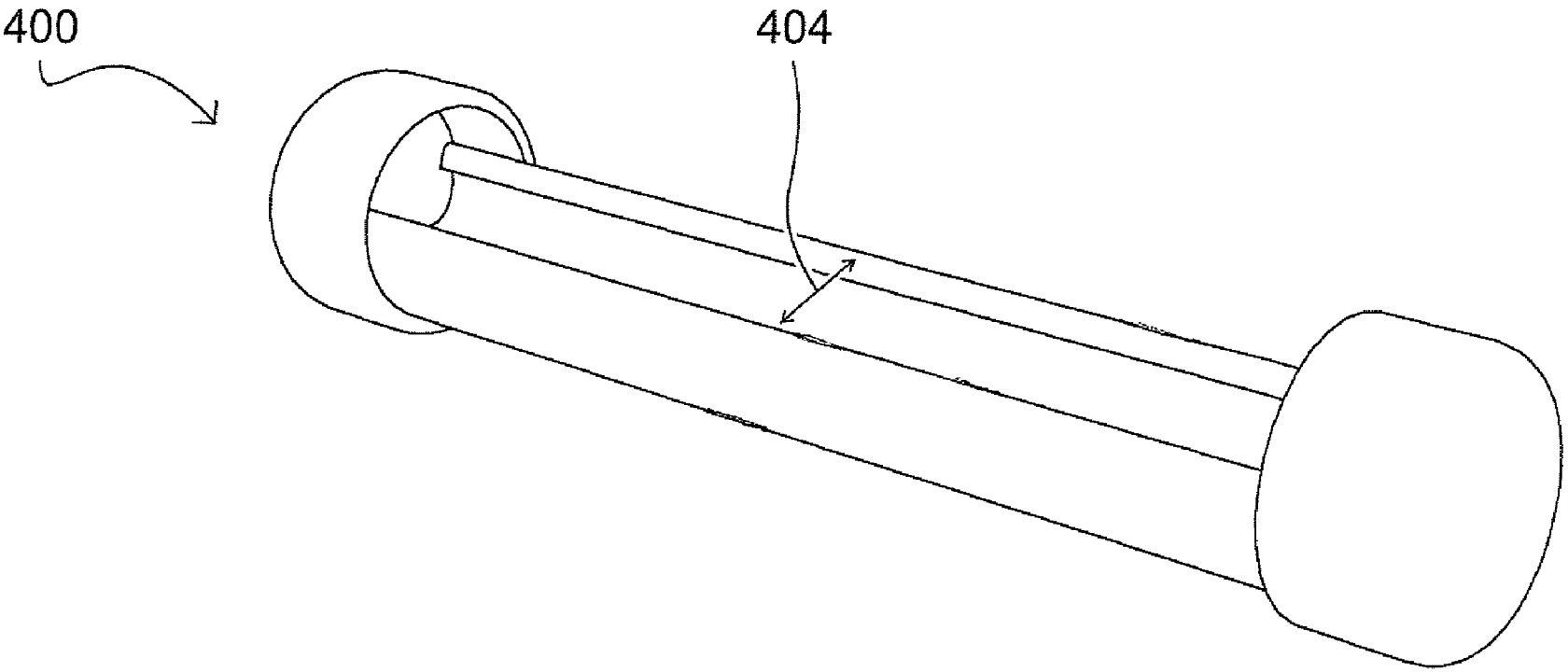
FIGS. 4A-4B show a first embodiment of the present invention.
Figure 4B:
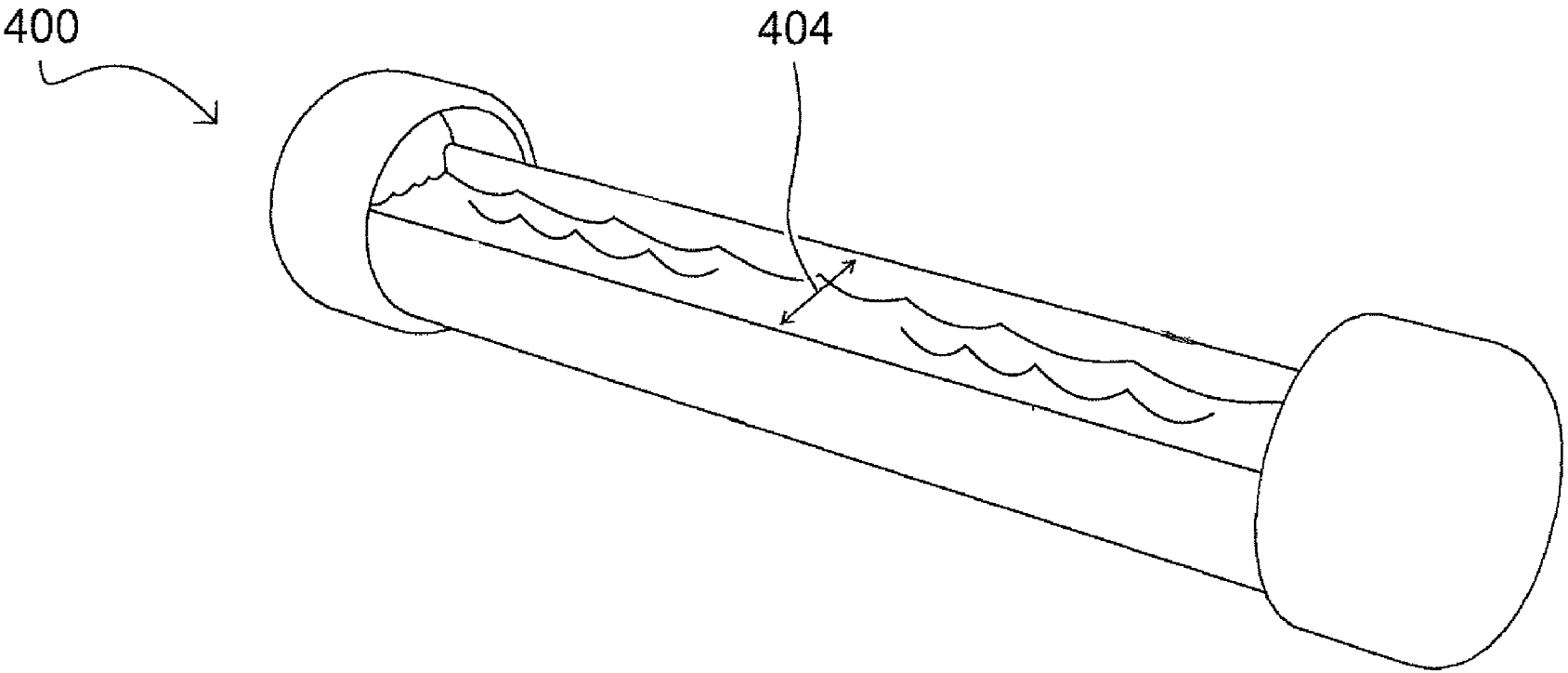
Figure 4C:
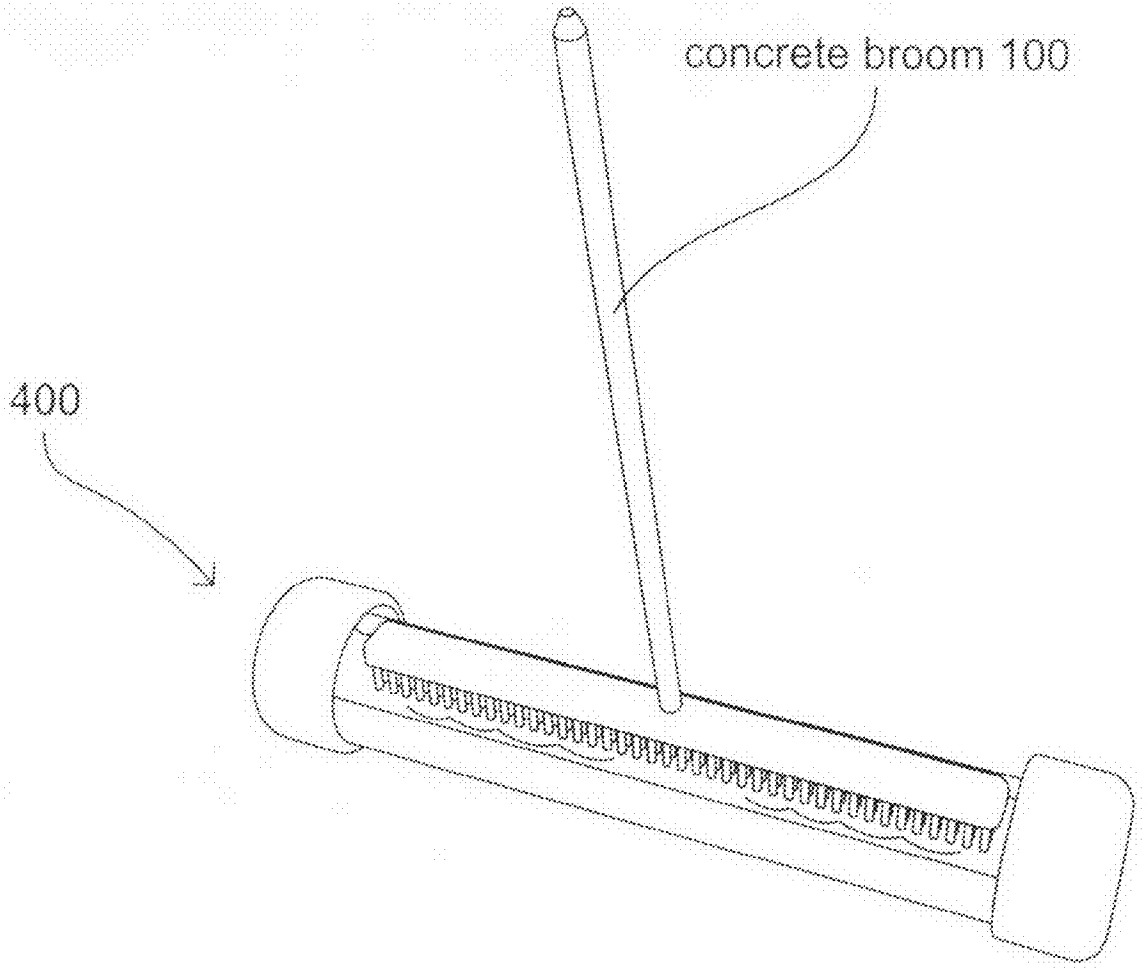
FIGS. 4C and 4D show a broom being inserted and withdrawn from the embodiment of FIGS. 4A-4B.
Figure 4D:
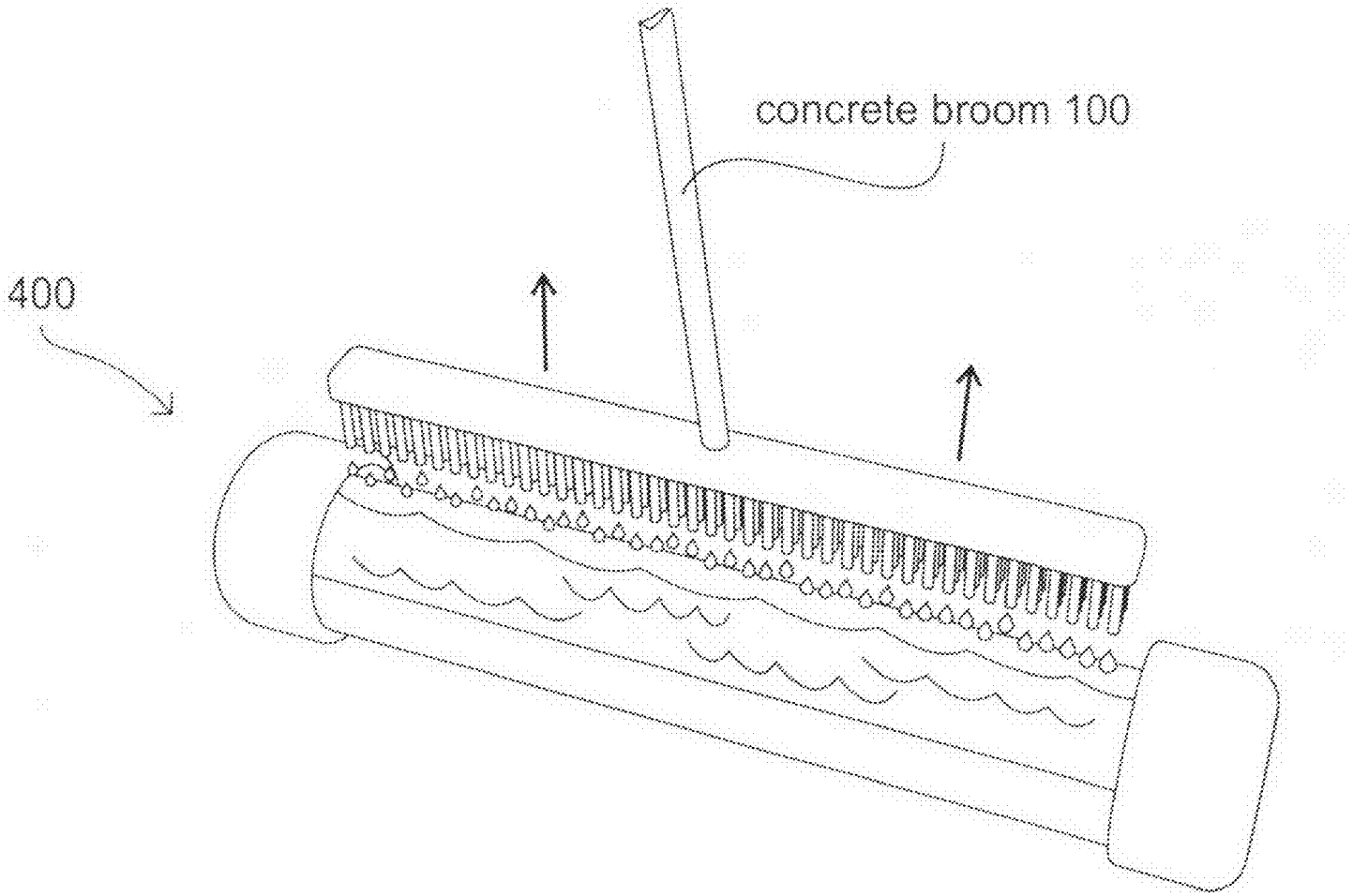

Accordingly, to address these and other issues, FIG. 4A shows a first embodiment of the present invention, in which a trough 400 is shown positioned on the ground. Water can be placed inside the trough 400 by a user through the aperture 404. FIG. 4B shows the trough of FIG. 4A filled with water. As shown in FIGS. 4C and 4D, the broom 100 can be consistently and entirely wetted inside the trough 400, by inserting the bristles 104 of the broom 100 through the aperture 404 of the trough 400.

Figure 6:
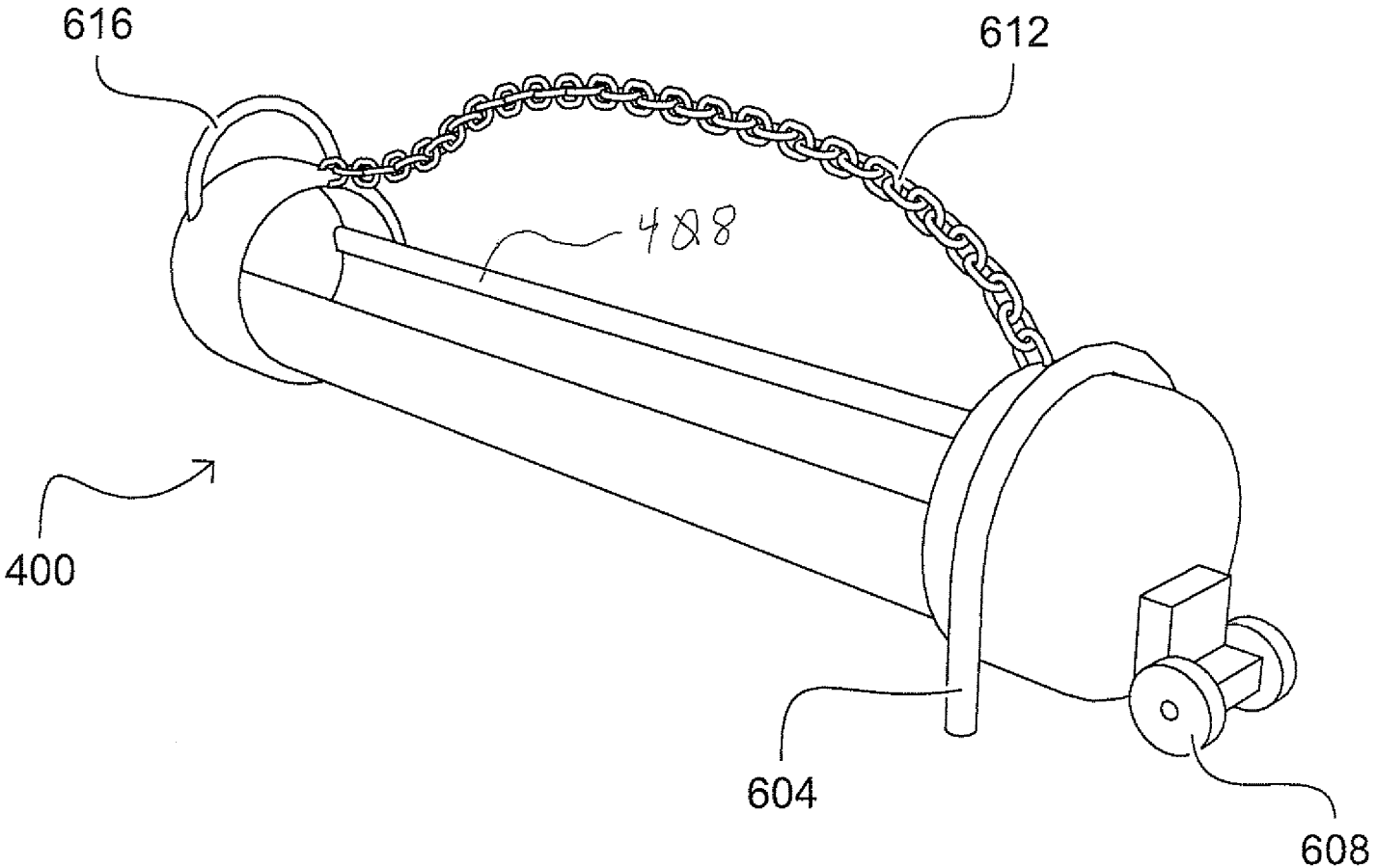
FIG. 6 shows additional features that of the present invention.

FIG. 6 also shows folds 408 that are manufactured within the trough 400, along the edges of the aperture 404. The folds 408 can assist in reducing the displacement of water while the broom is inserted and withdrawn therefrom.

The trough 400 can be manufactured from a high durability plastic that is resistant to changes in temperature.

It is to be noted that the embodiments of FIGS. 4A-4D are but for exemplary purposes only, so that the present invention should not be considered as limited exclusively thereto. Other possible configurations are also contemplated within the spirit and scope of the present invention.

After the trough 400 is no longer in use, and all water is removed therefrom, some setting and sticking of concrete chunks may occur on its interior. It is desired to avoid such chunks because cleaner water with reduced concrete means the broom 100 can be used for a longer period. Accordingly, one way to remove these unwanted chunks is by knocking the trough 400 against a hard surface, and then shaking out the chunks through the aperture 404. Even then, some of the chunks may require extra effort to be bounced out as they are impeded from passing through the aperture 404 by the splash-guard folds 408.

Figure 5:
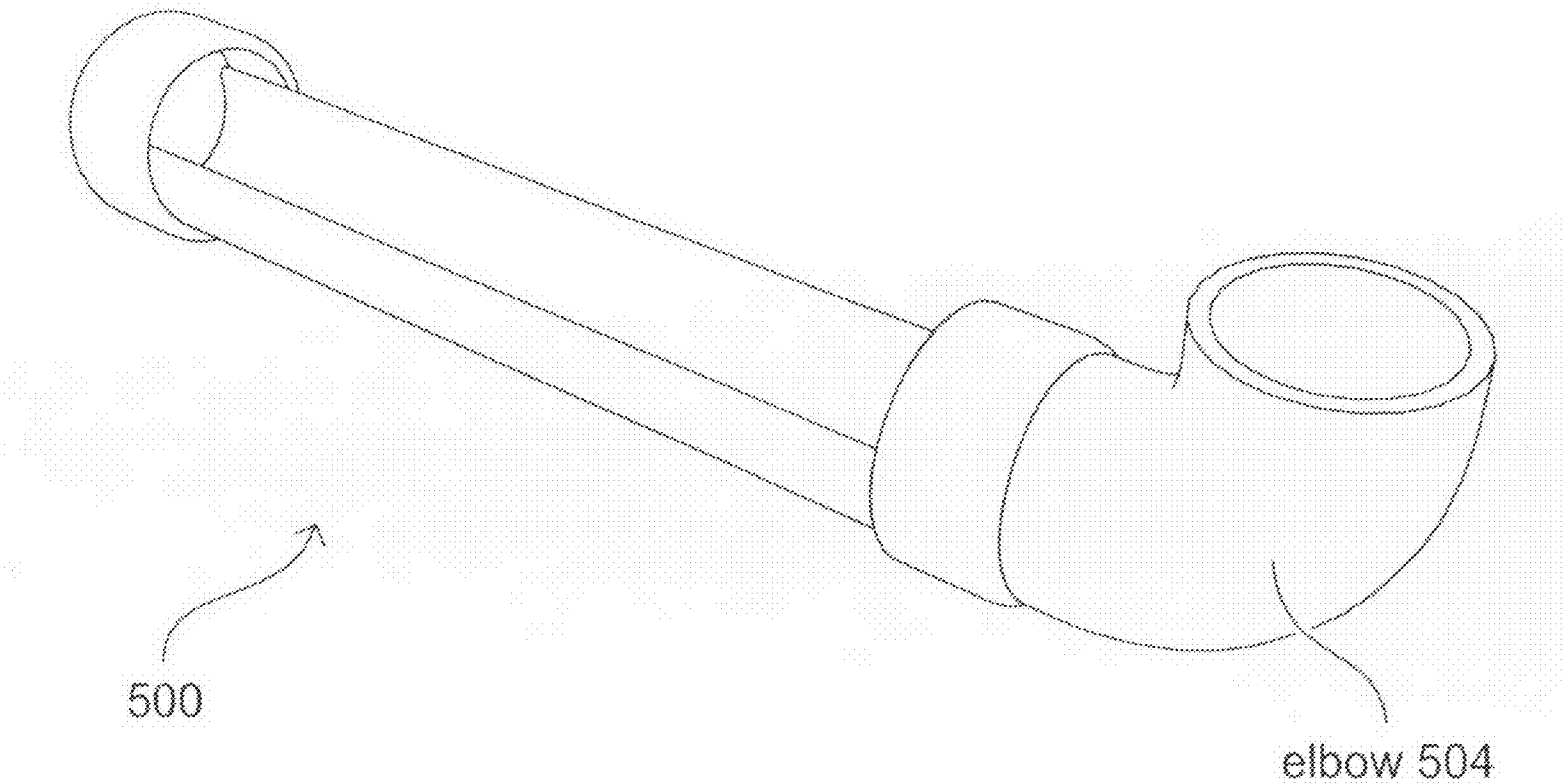
FIG. 5 shows a modified embodiment of the trough of FIG. 4.

To address this, FIG. 5 shows a modified embodiment of the trough 500, in which an elbow joint 504 is included. This elbow joint 504 is convenient because it allows a user to crack loose the unwanted surplus concrete chunks from inside the trough 500 when in a dry state. After being cracked loose, these unwanted chunks can be poured out the side of trough 500, rather than have to turn the previous embodiment i.e. trough 400 upside down and shake the chunks out. Accordingly, using the embodiment shown in FIG. 5, the accumulation of unwanted surplus concrete fragments can be more easily removed. The elbowed trough 500 shown in FIG. 5 also provides an easy way to fill with water, and to dump that water when completed.

FIG. 6 shows additional features that can be included with the present invention, including a tip-guard 604, wheels 608, chain 612, and/or handle 616. Although these features are shown in FIG. 6 as modifying the trough 400, they could also modify the trough 500, or other embodiments as well.

It is anticipated that various changes may be made in the arrangement and operation of the system of the present invention without departing from the spirit and scope of the invention, as depicted in the following claims.

What is claimed is:

1. A horizontal trough and concrete broom mechanism, comprising:

a concrete broom having a head connected to handle, where the head has bristles and a predetermined width and length, for use in smoothing concrete;

a semi-cylindrical hollow enclosure open on one side having a predetermined cross section and a horizontal length longer than the predetermined width of the concrete broom;

one or more end caps creating a watertight seal for the hollow enclosure, thereby creating a fluid channel therewithin;

wherein the hollow enclosure is sealed so as to be able to hold water for an extended period of time within the fluid channel;

further wherein the enclosure has an aperture for admitting the head and for allowing water to evenly access the entirety of the width of the head and all bristles therein;

wherein the head can be inserted and withdrawn from the trough in order to apply water evenly to all bristles;

a plurality of non-contiguous folds manufactured within the trough along the edges of the aperture for assisting in reducing the displacement of water while the head is inserted and withdrawn therefrom;

wherein the plurality of non-contiguous folds are located to be in parallel with each other.

2. The mechanism of claim 1, further comprising:

an elbow joint located at a distal end of the hollow enclosure.

3. The mechanism of claim 1, further comprising:

wherein the one or more end caps have a circumference; and a tip-guard located at one or both ends of the hollow enclosure and attached to the circumference of the cap or caps, for preventing the trough from tipping.

4. The mechanism of claim 1, further comprising:

wheels located at one end of the hollow enclosure, for facilitating easy movement of the trough.

5. The mechanism of claim 1, further comprising:

a chain attached to both ends of the hollow enclosure, for facilitating easy movement of the trough.

6. The mechanism of claim 1, further comprising:

a handle attached to one end of the hollow enclosure, for facilitating easy movement of the trough.

7. The mechanism of claim 1, further comprising:

the hollow enclosure being manufactured of a high durability plastic that is resistant to changes in temperature.

8. The mechanism of claim 2, further comprising:

wherein the elbow joint is used for emptying the interior of the trough both of water and also of unwanted concrete chunks.

* * * * *